US007866966B2

(12) United States Patent
Swartzlander

(10) Patent No.: US 7,866,966 B2
(45) Date of Patent: Jan. 11, 2011

(54) OPTIMIZED HELIX ANGLE ROTORS FOR ROOTS-STYLE SUPERCHARGER

(75) Inventor: Matthew G. Swartzlander, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 174 days.

(21) Appl. No.: 12/331,911

(22) Filed: Dec. 10, 2008

(65) Prior Publication Data

US 2009/0148330 A1 Jun. 11, 2009

Related U.S. Application Data

(63) Continuation of application No. 11/135,220, filed on May 23, 2005, now Pat. No. 7,488,164.

(51) Int. Cl.
*F01C 1/18* (2006.01)

(52) U.S. Cl. ..... 418/206.5; 418/205; 418/191

(58) Field of Classification Search ..... 418/206.4, 418/206.5, 205, 191, 206.1, 150
See application file for complete search history.

(56) References Cited

U.S. PATENT DOCUMENTS 2,654,530 A 10/1953 Oldberg
3,986,801 A 10/1976 Garland
4,210,410 A 7/1980 Ohtani
4,329,130 A 5/1982 Nagata et al.
4,643,655 A 2/1987 Uthoff et al.
4,768,934 A * 9/1988 Soeters, Jr. ..... 418/1
5,078,583 A 1/1992 Hampton et al.
6,884,050 B2 * 4/2005 Prior ..... 418/201.1

FOREIGN PATENT DOCUMENTS

GB 676839 8/1952

* cited by examiner

*Primary Examiner*—Thomas Denion
*Assistant Examiner*—Douglas J. Duff
(74) *Attorney, Agent, or Firm*—Dykema Gossett PLLC

(57) ABSTRACT

A method of designing rotors for a Roots blower comprising a housing having cylindrical chambers, the housing defining an outlet port (19). The blower includes meshed, lobed rotors (37,39) disposed in the chambers, each rotor including a plurality N of lobes (47,49), each lobe having first (47*a*,49*a*) and second (47*b*,49*b*) axially facing end surfaces. Each lobe has its axially facing surfaces defining a twist angle (TA), and each lobe defines a helix angle (HA). The method of designing the rotor comprises determining a maximum ideal twist angle ($TA_M$) for the lobe as a function of the number N of lobes on the rotor, and then determining a helix angle (HA) for each lobe as a function of the maximum ideal twist angle ($TA_M$) and an axial length (L) between the end surfaces of the lobe. A rotor designed in accordance with this method is also provided.

9 Claims, 8 Drawing Sheets

15
11
21
19
13
23
25
17

OPTIMIZED HELIX ANGLE ROTORS FOR ROOTS-STYLE SUPERCHARGER

This continuation application claims the benefit of U.S. patent application Ser. No. 11/135,220, filed May 23, 2005 now U.S. Pat. No. 7,488,164, the disclosure of which is incorporated herein by reference.

BACKGROUND OF THE DISCLOSURE

The present invention relates to Roots-type blowers, and more particularly, to such blowers in which the lobes are not straight (i.e., parallel to the axis of the rotor shafts), but instead, are "twisted" to define a helix angle.

Conventionally, Roots-type blowers are used for moving volumes of air in applications such as boosting or supercharging vehicle engines. As is well known to those skilled in the art, the purpose of a Roots-type blower supercharger is to transfer, into the engine combustion chambers, volumes of air which are greater than the displacement of the engine, thereby raising ("boosting") the air pressure within the combustion chambers to achieve greater engine output horsepower. Although the present invention is not limited to a Roots-type blower for use in engine supercharging, the invention is especially advantageous in that application, and will be described in connection therewith.

In the early days of the manufacture and use of Roots-type blowers, it was conventional to provide two rotors each having two straight lobes. However, as such blowers were further developed, and the applications for such blowers became more demanding, it became conventional practice to provide rotors having three lobes, with the lobes being twisted. As is well known to those skilled in the art, one of the distinguishing features of a Roots-type blower is that it uses two identical rotors, wherein the rotors are arranged so that, as viewed from one axial end, the lobes of one rotor are twisted clockwise while the lobes of the meshing rotor are twisted counterclockwise. As is now also well known to those skilled in the art, the use of such twisted lobes on the rotors of a blower, of the type to which the invention relates, results in a blower having much better air handling characteristics, and producing much less in the way of air pulsation and turbulence.

An example of a Roots-type blower is shown in U.S. Pat. No. 2,654,530, assigned to the assignee of the present invention and incorporated herein by reference. Many of the Roots-type blowers which are now used as vehicle engine superchargers are of the "rear inlet" type, i.e., the supercharger is mechanically driven by means of a pulley which is disposed toward the front end of the engine compartment while the air inlet to the blower is disposed at the opposite end, i.e., toward the rearward end of the engine compartment. In most Roots-type blowers, the air outlet is formed in a housing wall, such that the direction of air flow as it flows through the outlet is radial relative to the axis of the rotors. Hence, such blowers are referred to as being of the "axial inlet, radial outlet" type. It should be understood that the present invention is not absolutely limited to use in the axial inlet, radial outlet type, but such is clearly a preferred embodiment for the invention, and therefore, the invention will be described in connection therewith.

A more modern example of a Roots-type blower is shown in U.S. Pat. No. 5,078,583, also assigned to the assignee of the present invention and incorporated herein by reference. In Roots-type blowers of the "twisted lobe" type, one feature which has become conventional is an outlet port which is generally triangular, with the apex of the triangle disposed in a plane containing the outlet cusp defined by the overlapping rotor chambers. Typically, the angled sides of the triangular outlet port define an angle which is substantially equal to the helix angle of the rotors (i.e., the helix angle at the lobe O.D.), such that each lobe, in its turn, passes by the angled side of the outlet port in a "line-to-line" manner. In accordance with the teachings of the above-incorporated U.S. Pat. No. 5,078,583, it has been necessary to provide a backflow slot on either side of the outlet port to provide for backflow of outlet air to transfer control volumes of air trapped by adjacent unmeshed lobes of the rotor, just prior to traversal of the angled sides of the outlet port. Although the present invention is not limited to use with a blower housing having a triangular outlet port in which the angle defined by the angled side corresponds to the helix angle of the rotors, such an arrangement is advantageous, and the invention will be described in connection therewith.

As is now well known to those skilled in the art, and as will be illustrated in the subsequent drawings, a Roots-type blower has overlapping rotor chambers, with the locations of overlap defining what are typically referred to as a pair of "cusps", and hereinafter, the term "inlet cusp" will refer to the cusp adjacent the inlet port, while the term "outlet cusp" will refer to the cusp which is interrupted by the outlet port. Also, by way of definition, it should be understood that references hereinafter to "helix angle" of the rotor lobes is meant to refer to the helix angle at the pitch circle of the lobes.

One of the important aspects of the present invention relates to a Roots blower parameter know as the "seal time" wherein the reference to "time" is a misnomer, as the term actually is referring to an angular measurement (i.e., in rotational degrees). Therefore, "seal time" refers to the number of degrees that a rotor lobe (or a control volume) travels in moving from through a particular "phase" of operation, as the various phases will be described hereinafter. In discussing "seal time" it is important to be aware of a quantity defined as the number of degrees between adjacent lobes, referred to as the "lobe separation". Therefore, in the conventional, prior art Rootstype blower, having three lobes, the "lobe separation" (L.S.) is represented by the equation: L.S.=360/N and with N=3, the lobe separation L.S. is equal to 120 degrees. There are four phases of operation of a Roots-type blower, and for each phase there is an associated seal time as follows: (1) the "inlet seal time" is the number of degrees of rotation during which the control volume is exposed to the inlet port; (2) the "transfer seal time" is the number of degrees of rotation during which the transfer volume is sealed from both the inlet "event" and the backflow "event"; (3) the "backflow seal time" is the number of degrees during which the transfer volume is open to the "backflow" port (as that term will be defined later), prior to discharging to the outlet port; and (4) the "outlet seal time" is the number of degrees during which the transfer volume is exposed to the outlet port.

Another significant parameter in a Roots-type blower is the "twist angle" of each lobe, i.e., the angular displacement, in degrees, which occurs in "traveling" from the rearward end of the rotor to the forward end of the rotor. It has been common practice in the Roots-type blower art to select a particular twist angle and utilize that angle, even in designing and developing subsequent blower models. By way of example only, the assignee of the present invention has, for a number of years, utilized a sixty degree twist angle on the lobes of its blower rotors. This particular twist angle was selected largely because, at that time, a sixty degree twist angle was the largest twist angle the lobe hobbing cutter then being used could accommodate. Therefore, with the twist angle being predetermined, the helix angle for the lobe would be determined by applying known geometric relationships, as will be described in greater detail subsequently. It has also been known in the Roots-type blower art to provide a greater twist angle (for example, as much as 120 degrees), and that the result would be a higher helix angle and an improved performance, specifically, a higher thermal compressor efficiency, and lower input power.

As is also well known to those skilled in the art, and as will be described in greater detail subsequently, the air flow characteristics of a Roots-type blower and the speed at which the blower rotors can be rotated are a function of the lobe geometry, including the helix angle of the lobes. Ideally, the linear velocity of the lobe mesh (i.e., the linear velocity of a point at which meshed rotor lobes move out of mesh) should approach the linear velocity of the air entering the rotor chambers through the inlet port. If the linear velocity of the lobe mesh (referred to hereinafter as "V3"is much greater than the linear velocity of incoming air (referred to hereinafter as "V1"), the result will be that the movement of the lobe will, in effect, draw at least a partial vacuum on the inlet side. Such a mismatch of V1 and V3 will cause pulsations, turbulence and noise, (and creating such requires "work"), all of which are serious disadvantages on an engine supercharger, rotating at speeds of as much as 15,000 to about 18,000 rpm.

Those skilled in the art of Roots-type blower superchargers have, for some time, recognized that it would be desirable to be able to increase the "pressure ratio" of the blower, i.e., the ratio of the outlet pressure (absolute) to inlet pressure (absolute). A higher pressure ratio results in a greater horsepower boost for the engine with which the blower is associated. The assignee of the present invention has utilized, as a design criteria, not to let the Roots-type blower exceed a pressure ratio which results in an outlet air temperature in excess of 150 degrees Celsius.

BRIEF SUMMARY OF THE INVENTION

Accordingly, it is an object of the present invention to provide a Roots-type blower in which the rotors and lobes are designed to provide improved overall operating efficiency of the blower, and especially, improved thermal efficiency, and reduced input power.

A Roots-type blower includes a housing defining first and second transversely overlapping cylindrical chambers and first and second meshed, lobed rotors disposed, respectively, in said first and second chambers. The housing includes a first end wall defining an inlet port, and an outlet port formed at an intersection of the first and second chambers and adjacent to a second end wall. Each rotor includes a number of lobes, each lobe having first and second axially facing end surfaces sealingly cooperating with said first and second end walls, respectively, and a top land sealingly cooperating with said cylindrical chambers, said lobes defining a control volume between adjacent lobes on a rotor. In an embodiment, the inlet port being is in at least partial communication with two control volumes on each of the first and second rotors.

In another embodiment, the lobes cooperate with an adjacent surface of the first and second chambers to define at least one blowhole that occurs in a cyclic manner and moves linearly, as the lobe mesh moves linearly, in a direction toward the outlet port. The blowhole provides adjacent control volumes in communication. At a first rotor rotational speed, the blowhole provides adjacent control volumes in communication such that there is no internal compression of the fluid within the blower and, at a second rotor rotational speed greater than the first rotor rotational speed, the blowhole provides adjacent control volumes in communication, but there is internal compression of the fluid within the blower.

DETAILED DESCRIPTION OF THE PREFERRED EMBODIMENT

Figure 1:
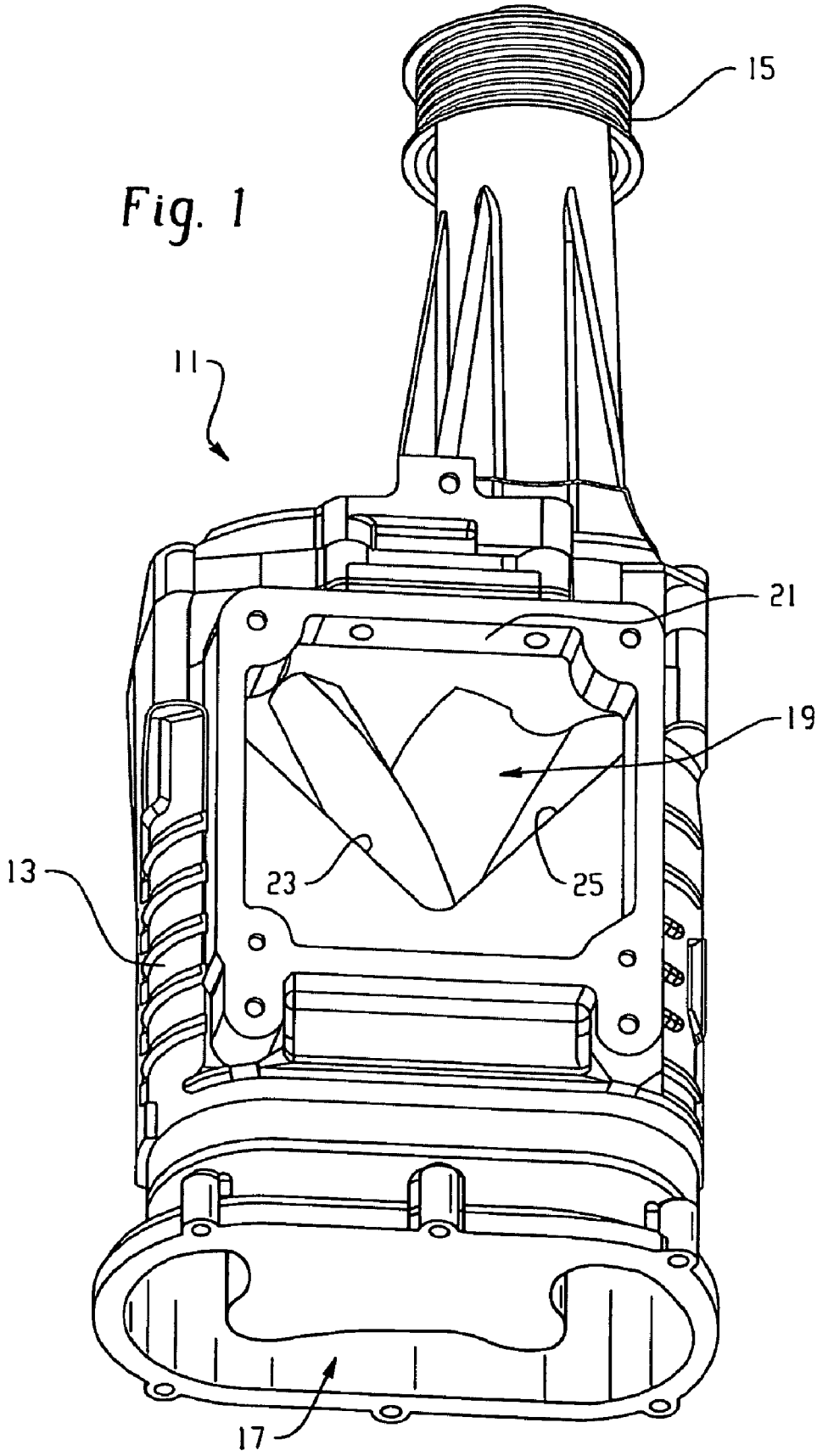
FIG. 1 is a perspective view of a Roots-type blower of the type which may utilize the present invention, showing both the inlet port and the outlet port.

Referring now to the drawings, which are not intended to limit the invention, FIG. 1 is an external, perspective view of a Roots-type blower, generally designated 11 which includes a blower housing 13. As was described in the background of the disclosure, the blower 11 is preferably of the rear inlet, radial outlet type and therefore, the mechanical input to drive the blower rotors is by means of a pulley 15, which would be disposed toward the forward end of the engine compartment. Toward the "lower" end of the view in FIG. 1, the blower housing 13 defines an inlet port, generally designated 17.

The blower housing 13 also defines an outlet port, generally designated 19 which, as may best be seen, in FIG. 1, is generally triangular including an end surface 21 which is generally perpendicular to an axis A (see FIG. 2) of the blower 11, and a pair of side surfaces 23 and 25 which will be referenced further subsequently. It is a requirement in such a blower that the inlet port be configured such that the inlet seal time be at least equal to the amount of the rotor lobe twist angle. Therefore, the greater the twist angle, the greater the inlet port "extent" (in rotational degrees), when the outside of the port is "constrained" by the outside diameter of the rotor bores. The inlet seal time must be at least equal to the twist angle to insure that the transfer volume is fully out of mesh prior to closing off communication of this volume to the inlet port.

Figure 2:
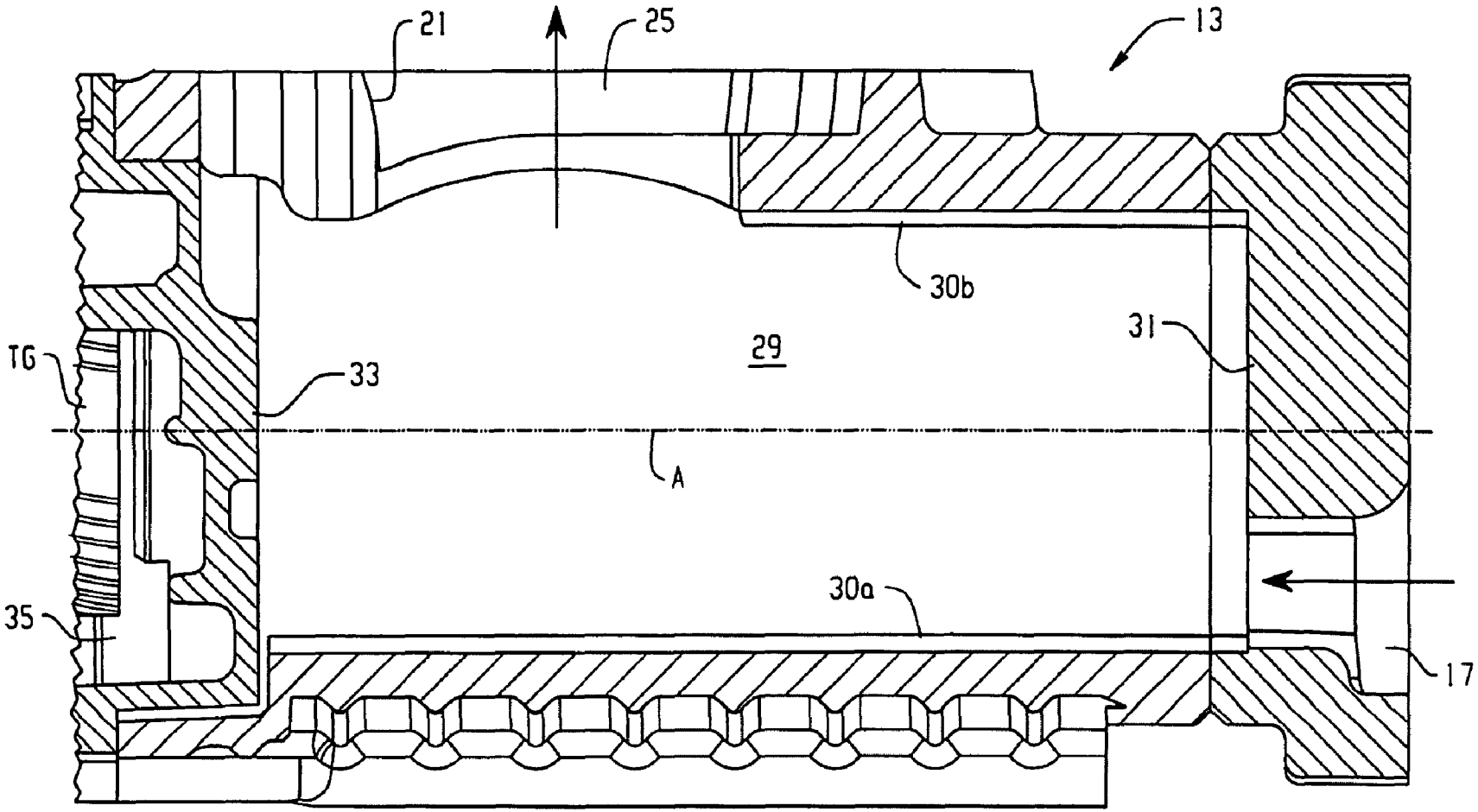
FIG. 2 is an axial cross-section of the housing of the blower shown in perspective view in FIG. 1, but with the rotors removed for ease of illustration.
Figure 3:
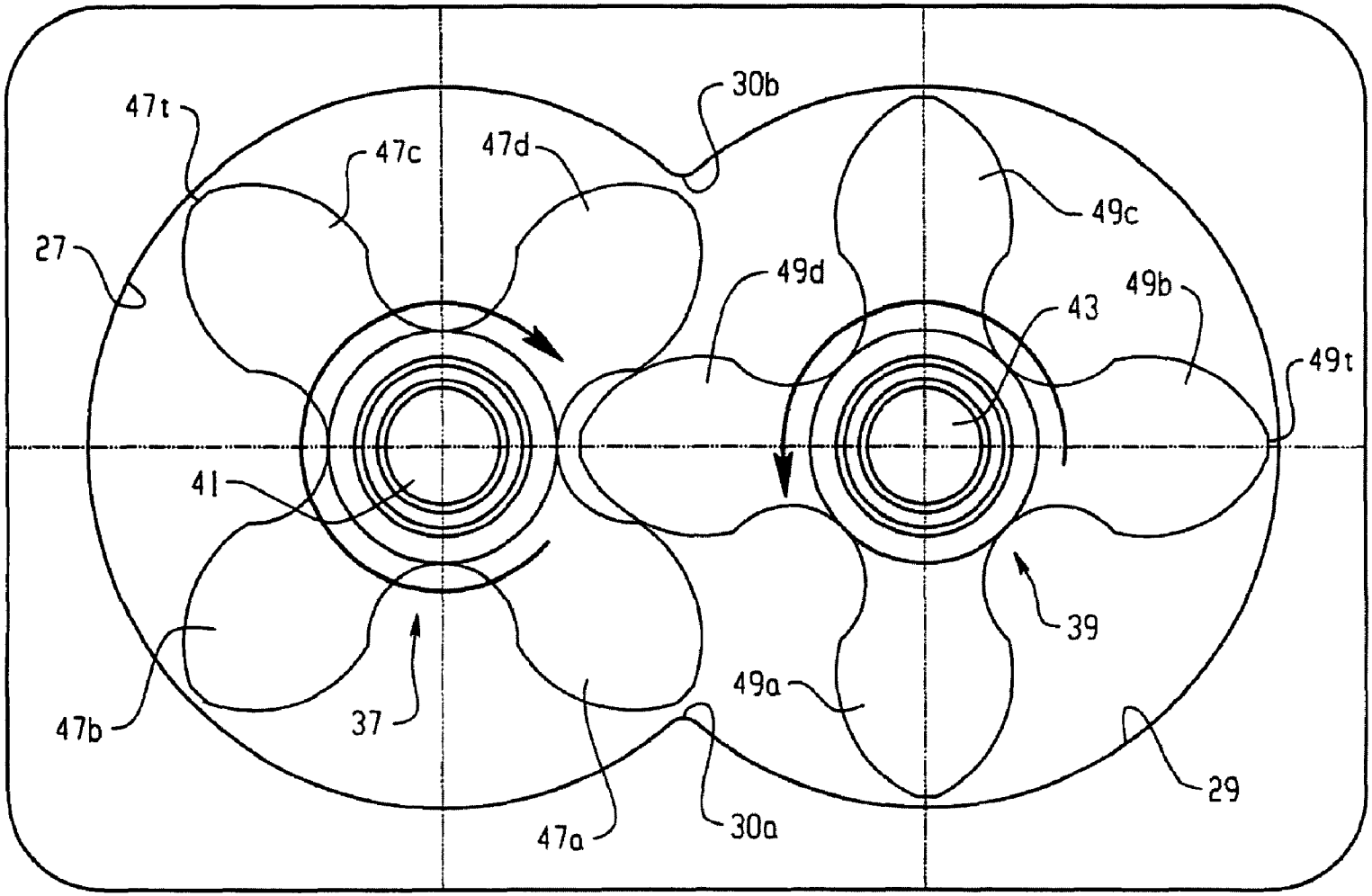
FIG. 3 is a somewhat diagrammatic view, corresponding to a transverse cross-section through the blower, illustrating the overlapping rotor chambers and the rotor lobes.

Referring now primarily to FIG. 2, bit in conjunction with FIG. 3, the blower housing 13 defines a pair of transversely overlapping cylindrical chambers 27 and 29, such that in FIG. 2, the view is from the chamber 27 into the chamber 29. In FIG. 3, the chamber 29 is the right hand chamber, FIG. 3 being a view taken from the rearward end (right end in FIG. 2) of the rotor chamber, i.e., looking forwardly in the engine compartment. The blower chambers 27 and 29 overlap at an inlet cusp 30*a* (which is in-line with the inlet port 17), and overlap at an outlet cusp 30*b* (which is in -line with, and actually is interrupted by the outlet port 19).

Referring now primarily to FIG. 2, the blower housing 13 defines a first end wall 31 through which passes the inlet port 17, and therefore, for purposes of subsequent description and the appended claims, the first end wall 31 is referenced as "defining" the inlet port 17. At the forward end of the chambers 27 and 29, the blower housing 13 defines a second end wall 33 which separates the cylindrical rotor chambers 27 and 29 from a gear chamber 35 which, as is well known to those skilled in the art, contains the timing gears, one of which is shown partially broken away and designated TG. The construction and function of the timing gears is not an aspect of the present invention, is well known to those skilled in the art, and will not be described further herein.

Figure 4:
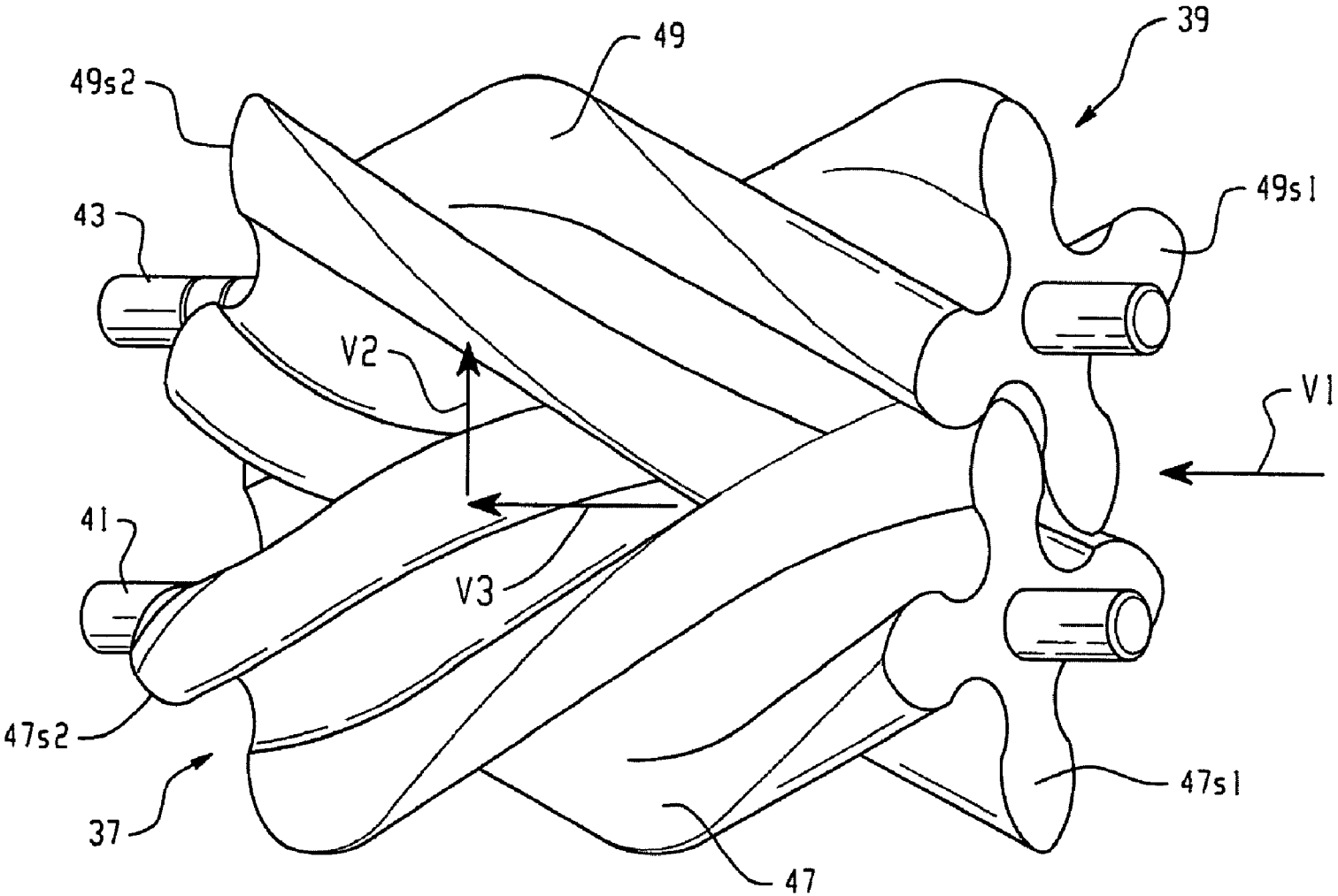
FIG. 4 is a top mostly plan view of the rotor set shown diagrammatically in FIG. 3, and illustrating the helix angle of the lobes.

Referring now primarily to FIG. 3, but also to FIG. 4, it may be seen that disposed within the rotor chamber 27 is a rotor generally designated 37, and disposed within the rotor chamber 29 is a rotor, generally designated 39. The rotor 37 is fixed relative to a rotor shaft 41 and the rotor 39 is fixed relative to a rotor shaft 43. The general construction of Roots-type blower rotors, and the manner of mounting them on the rotor shafts is generally well known to those skilled in the art, is not especially relevant to the present invention, and will not be described further herein. Those skilled in the art will recognize that there are a number of different methods known and available for forming blower rotors, and for thereafter fixedly mounting such rotors on their rotor shafts. For example, it is known to produce solid rotors, having the lobes hobbed by a hobbing cutter, and it is also generally known how to extrude rotors which are hollow, but with the ends thereof enclosed or sealed. Unless specifically otherwise recited in the appended claims, the present invention may be utilized in connection with lobes of any type, no matter how formed, and in connection with any manner of mounting the rotors to the rotor shafts.

In the subject embodiment, and by way of example only, each of the rotors 37 and 39 has a plurality N of lobes, the rotor 37 having lobes generally designated 47 and the rotor 39 having lobes generally designated 49. In the subject embodiment, and by way of example only, the plurality N is illustrated to be equal to 4, such that the rotor 47 includes lobes 47*a*, 47*b*, 47*c*, and 47*d*. In the same manner, the rotor 39 includes lobes 49, 49*a*, 49*b*, 49*c*, and 49*d*. The lobes 47 have axially facing end surfaces 47*s*1 and 47*s*2, while the lobes 49 have axially facing end surfaces 49*s*1 and 49*s*2. It should be noted that in FIG. 4, the end surfaces 47*s*1 and 49*s*1 are actually visible, whereas for the end surfaces 47*s*2 and 49*s*2, the lead lines merely "lead to" the ends of the lobes because the end surfaces are not visible in FIG. 4. The end surfaces 47*s*1 and 49*s*1 sealingly cooperate with the first end wall 31, while the end surfaces 47*s*2 and 49*s*2 sealingly cooperate with the second end wall 33, in a manner well known to those skilled in the art, and which is not directly related to the present invention.

As is well known to those skilled in the Roots-type blower art, when viewing the rotors from the inlet end as in FIG. 3, the left hand rotor 37 rotates clockwise, while the right hand rotor 39 rotates counterclockwise. Therefore, air which flows into the rotor chambers 27 and 29 through the inlet port 17 will flow into, for example, a control volume defined between the lobes 47*a* and 47*b*, or between the lobes 49*a* and 49*b*, and the air contained in those control volumes will be carried by their respective lobes, and in their respective directions around the chambers 27 and 29, respectively, until those particular control volumes are in communication with the outlet port 19. Each of the lobes 47 includes a top land 47*t*, and each of the lobes 49 includes a top land 49*t*, the top lands 47*t* and 49*t* sealingly cooperating with the cylindrical chambers 27 and 29, respectively, as is also well known in the art, and will not be described further herein.

As used herein, the term "control volume" will be understood to refer, primarily, to the region or volume between two adjacent unmeshed lobes, after the trailing lobe has traversed the inlet cusp, and before the leading lobe has traversed the outlet cusp. However, it will be understood by those skilled in the art that the region between two adjacent lobes (e.g., lobes 47*d* and 47*a*) also passes through the rotor mesh, as the lobe 49*d* is shown in mesh between the lobes 47*d* and 47*a* in FIG. 3. Each region, or control volume, passes through the four phases of operation described in the Background of the Disclosure, i.e., the inlet phase; the transfer phase; the backflow phase; and the outlet phase. Therefore, viewing FIG. 3, the control volume between the lobes 47*a* and 47*b* (and between lobes 49*a* and 49*b*) comprises the inlet phase, as does the control volume between the lobes 47*b* and 47*c*. The control volume between the lobes 47*c* and 47*d* is in the transfer phase, just prior to the backflow phase. As soon as the lobe 47*d* passes the outlet cusp 30*b* in FIG. 3, the control volume between it and the lobe 47*c* will be exposed to the backflow phase. Once the lobe 47*d* passes the outlet cusp 30, at the plane of the inlet port (FIG. 3), the control volume is exposed to the outlet pressure through a "blowhole", to be described subsequently. To insure that there is not a leak back to the inlet port 17, the control volume between lobes 47*c* and 47*d* must be completely out of communication with the inlet port, i.e., must be out of the inlet phase. With the lobe 47*d* being the "leading" lobe, and the lobe 47*c* being the "trailing" lobe of the control volume, the trailing lobe 47*c* must still be sealed to the chamber 27 at the peak of the inlet cusp 30*a*, when the leading lobe 47*d* is still sealed to the outlet cusp 30*b*, as shown in FIG. 3. The above requirement indicates the maximum amount of seal time for the inlet seal time and the transfer seal time, together, which will be significant in determining the maximum, ideal twist angle subsequently.

In accordance with an important aspect of the invention, it has been recognized that the performance of a Roots-type blower can be substantially improved by substantially increasing the twist angle of the rotor lobes which, in and of itself does not directly improve the performance of the blower. However, increasing the twist angle of the rotor lobes, in turn, permits a substantial increase in the helix angle of each lobe. More specifically, it has been recognized, as one aspect of the present invention, that for each blower configuration, it is possible to determine a maximum ideal twist angle which could then be utilized to determine an "optimum" helix angle. By "maximum ideal twist angle" what is meant is the largest possible twist angle for each rotor lobe without opening a leak path from the outlet port 19 back to the inlet port 17 through the lobe mesh, as the term "leak path" will be subsequently described.

Figure 5:
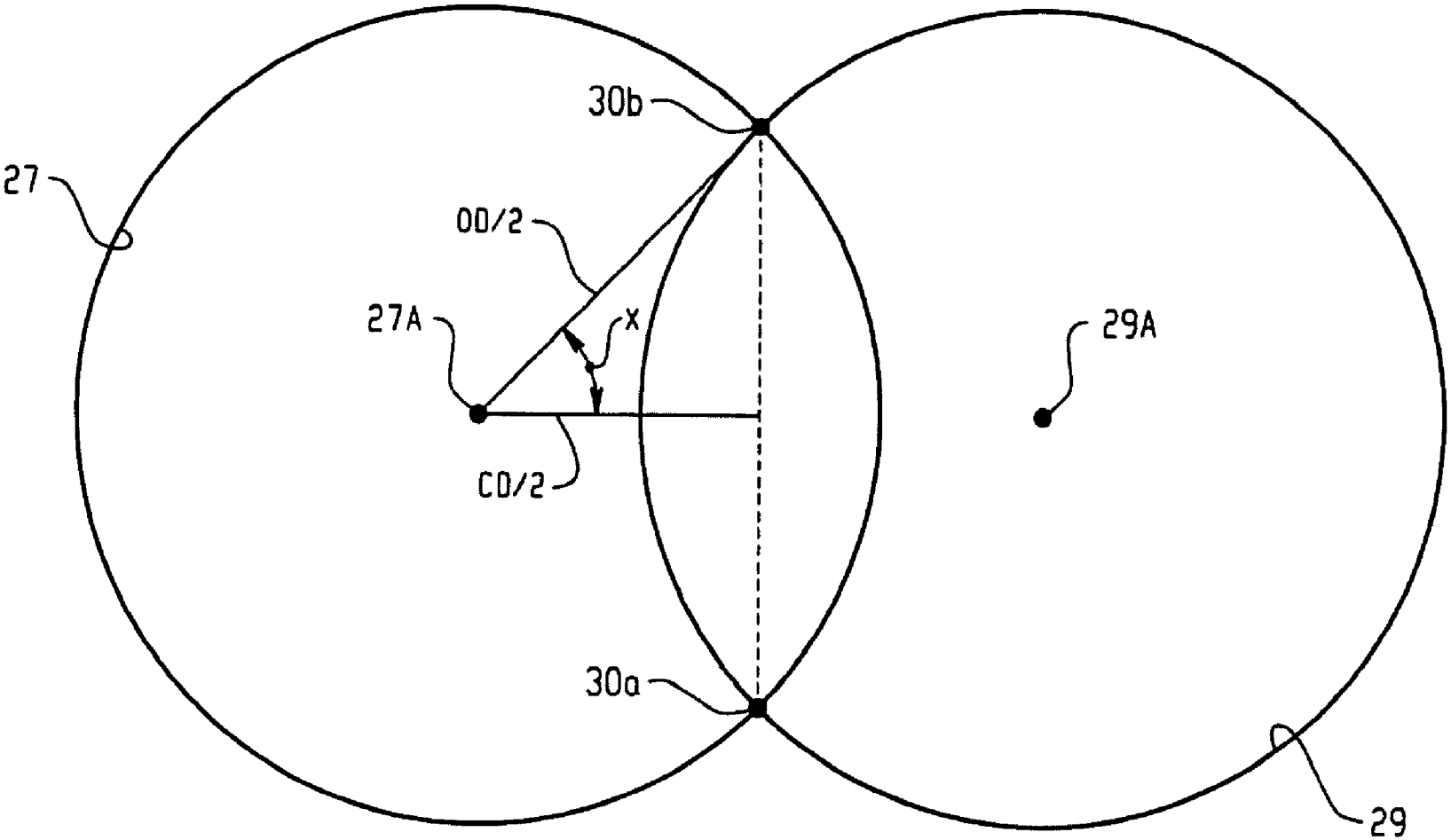
FIG. 5 is a geometric view representing the rotor chambers, for use in determining the maximum ideal twist angle, which comprises one important aspect of the invention.

Referring now primarily to FIG. 5, one important aspect of the present invention is the recognition that there is an "ideal" maximum twist angle, and that once the ideal maximum twist angle is calculated, it can be used to determine a maximum (optimum) helix angle for the lobes 47 and 49. FIG. 5 illustrates a geometric view of the rotor chambers (overlapping cylindrical chambers) 27 and 29 which define chamber axes 27A and 29A, respectively. As may best be seen by comparing FIG. 5 to FIG. 3, the chamber axis 27A is the axis of rotation of the rotor shaft 41, while the chamber axis 29A is the axis of rotation of the rotor shaft 43. Therefore, FIG. 5 bears a designation "CD/2" which is a line which represents one -half of the center-to-center distance between the chamber axes 27A and 29A.

As was explained previously, the cylindrical chambers 27 and 29 overlap along lines which then are the inlet cusp 30*a* and the outlet cusp 30*b*. FIG. 5 bears a designation "OD/2" which is substantially equal to one-half of the outside diameter defined by the rotor lobes 47 or 49. In determining the ideal maximum twist angle it has been recognized, as one aspect of the invention, that it is necessary to determine the rotational angle between the inlet cusp 30*a* and the outlet cusp 30*b*. Therefore, in the geometric view of FIG. 5, there is labeled an angle "X" which, as may be seen in FIG. 5, represents one-half of the angle between the inlet cusp 30*a* and the outlet cusp 30*b*. The angle X may be determined by the equation:

$$\text{Cosine } X = CD/OD; \text{ or stated another way,}$$

$$X = Arc \cos CD/OD.$$

From the above, it has been determined that the maximum ideal twist angle ($TA_M$) may be determined as follows:

$TA_M$=360−(2 times X)−(360/N); wherein.

2 times X=cusp-to-cusp separation

N=the number of lobes per rotor

360/N=lobe-to-lobe separation.

For the subject embodiment of the present invention, the maximum ideal twist angle ($TA_M$) has been determined to be about 170 degrees. It should be understood that, utilizing the above relationship, what is calculated is a twist angle for the lobes 47 and 49 which results in a total maximum seal time for the inlet seal time and the transfer seal time, together, but wherein the transfer seal time is equal to zero. Such an "allocation" of seal times between the inlet and transfer (with transfer seal time=0) leads to the "ideal" maximum twist angle for relatively high speed performance. As will be understood by those skilled in the art, upon a reading and understanding of the present specification, if the goal is optimum performance at a relatively lower speed, the inlet seal time will be reduced, and the transfer seal time increased, correspondingly, but with the total of inlet and transfer remaining constant. In other words, the porting of the blower can be "tuned" for a particular vehicle application. In developing an improved method of designing a rotor for a Roots-type blower, the starting point was to determine an "optimum" helix angle, at which the "transfer" seal time is zero. If improved low-speed efficiency is required for a particular application, then the transfer seal time would be increased, as described above, with the inlet seal time decreasing accordingly, and the maximum ideal twist angle ($TA_M$) also decreasing accordingly.

The next step in the design method of the present invention is to utilize the maximum ideal twist angle $TA_M$ and the lobe length to calculate the helix angle (HA) for each of the lobes 47 or 49. By adjusting the lobe length, the optimal helix angle can be achieved. As was mentioned previously, it is understood that the helix angle HA is typically calculated at the pitch circle (or pitch diameter) of the rotors 37 and 39, as those terms are well understood to those skilled in the gear and rotor art. In the subject embodiment, and by way of example only, with the maximum ideal twist angle $TA_M$ being calculated to be approximately 170°, the helix angle HA is calculated as follows:

$$\text{Helix Angle } (HA) = (180/\pi^* \arctan (PD/\text{Lead}))$$

wherein:

PD=pitch diameter of the rotor lobes; and

Lead=the lobe length required for the lobe to complete 360 degrees of twist, the Lead being a function of the twist angle ($TA_M$) and the length of the lobe.

For the subject embodiment, the helix angle HA was calculated to be about 29 degrees.

It has been determined that one important benefit of the improved method of designing the rotors, in accordance with the present invention, is that it thereby becomes possible to increase the size and flow area of the inlet port 17. As may be appreciated by viewing FIG. 1, in conjunction with FIG. 3, the inlet port 17 has a greater arcuate or rotational extent (i.e., greater than the typical prior art), on each side of the inlet cusp 30*a*, thus increasing the period of time during which incoming air is flowing through the inlet port into the control volumes between adjacent lobes. For example, with the conventional, prior art inlet port as is used in most Roots-type blower for superchargers, the inlet port would permit air to flow into the control volume between the lobes 47*a* and 47*b*, and would be providing at least partial filling of the control volume between the lobes 49*a* and 49*b*. However, the conventional prior art inlet port would typically not be in open communication with, and permitting air to flow into, the control volume between the lobe 47*b* and the lobe 47*c*, but as may be seen by comparing FIGS. 1 and 3, the inlet port 17 as shown in FIG. 1 would be overlapping almost the entire control volume between the lobes 47*b* and 47*c*. At the same time, the inlet port 17, on the right side of FIG. 1, would still be in partial communication with the control volume between the lobes 49*b* and 49*c*.

Referring now primarily to FIG. 4, there is illustrated another important aspect of the present invention, which is related to the greatly increased helix angle (HA) of the lobes 47 and 49. As was mentioned in the background of the disclosure, it has been one of the disadvantages of prior art Roots blower superchargers that there typically has been a "mismatch" between the linear velocities of air entering the rotor chambers through the inlet port and the linear velocity of the lobe mesh. In FIG. 4, there are arrows labeled to identify various quantities which are relevant to a discussion of the way in which the present invention overcomes this "mismatch" in the prior art:

V1=linear velocity of inlet air flowing through the inlet port 17;

V2=linear velocity of the rotor lobe in the radial direction; and

V3=linear velocity of the lobe mesh.

Figure 6:
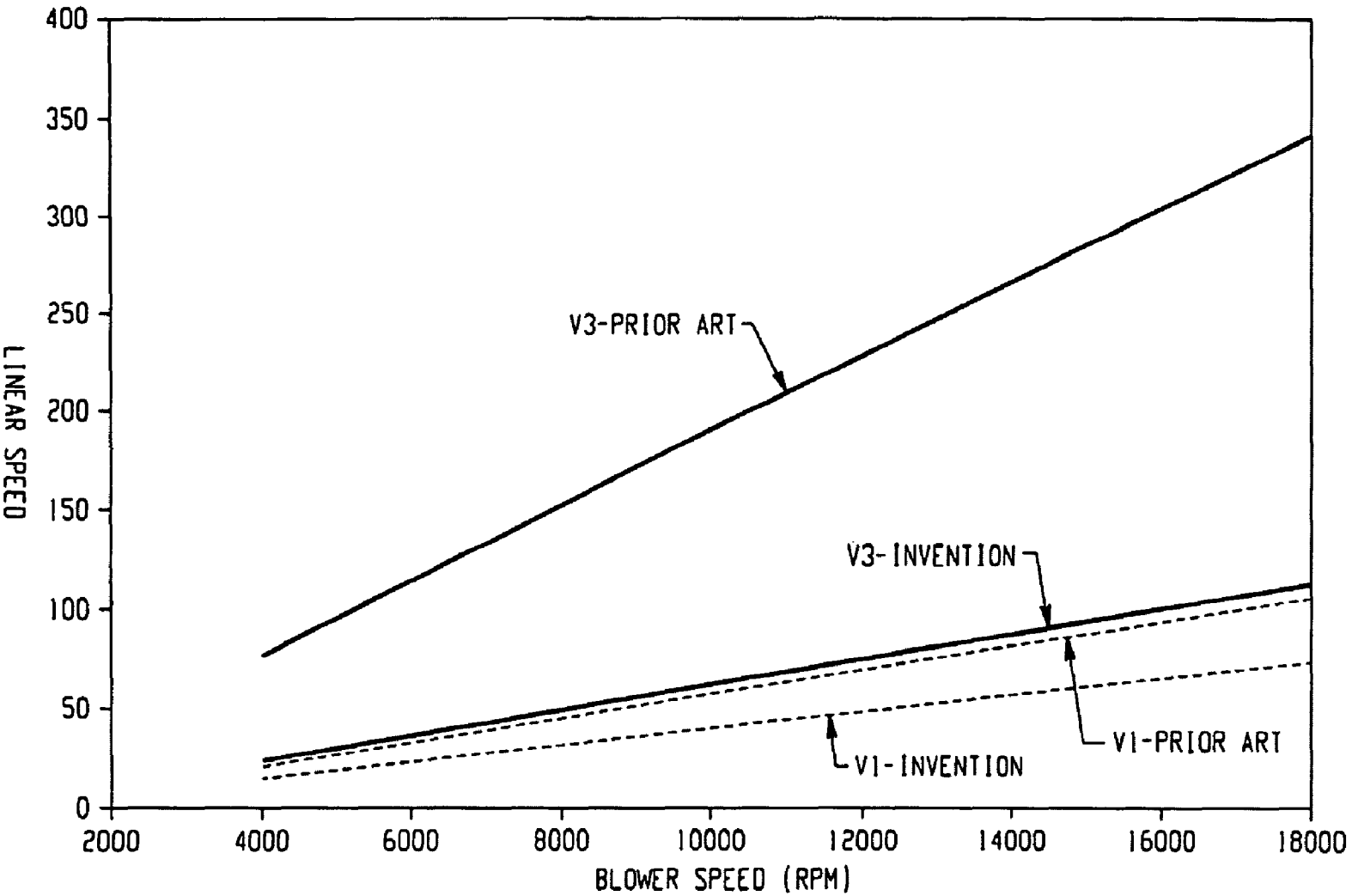
FIG. 6 is a graph of linear speed, in meters/second, showing both lobe mesh and inlet air speed, as a function of blower rotor speed of rotation (in RPM), comparing the Present Invention to the Prior Art.

Referring still to FIG. 4, but now in conjunction with the graph of FIG. 6, it may be seen that in the known "Prior Art" Roots-type blower, having the much smaller, prior art helix angles, there has been a substantial mismatch between V1 and V3 such that, in the "Prior Art" device, with the linear speed V3 of the lobe mesh traveling several times faster than the flow of inlet air V1, there would be a substantial amount of undesirable turbulence, and the creation of a vacuum, as discussed in the Background of the Disclosure. Furthermore, in the Prior Art device, it has been observed that, at approximately 8,500 rpm, the "generated noise" would exceed 100 db. By way of contrast, with the present Invention, it may be seen in FIG. 6 that the gap between V1 and V3 is much smaller, thus suggesting that there would be much less turbulence and much less likelihood of drawing a vacuum. By way of confirmation of this suggestion, it has been observed in testing a blower made in accordance with the present invention that the generated noise does not exceed 100 db, even as the blower speed has increased to greater than 16,000 rpm. It may be observed in the graphs of FIG. 6 that, for any given rotor lobe configuration (i.e., helix angle), V1 will "lag" V3, but as one important aspect of the invention, it has been observed and determined that, as the helix angle HA increases, the linear velocity V3 of the lobe mesh decreases, and the gap between V3 and V1 decreases, achieving the advantages of less air turbulence (pulsation), less vacuum being drawn, and less noise being generated.

Figure 7:
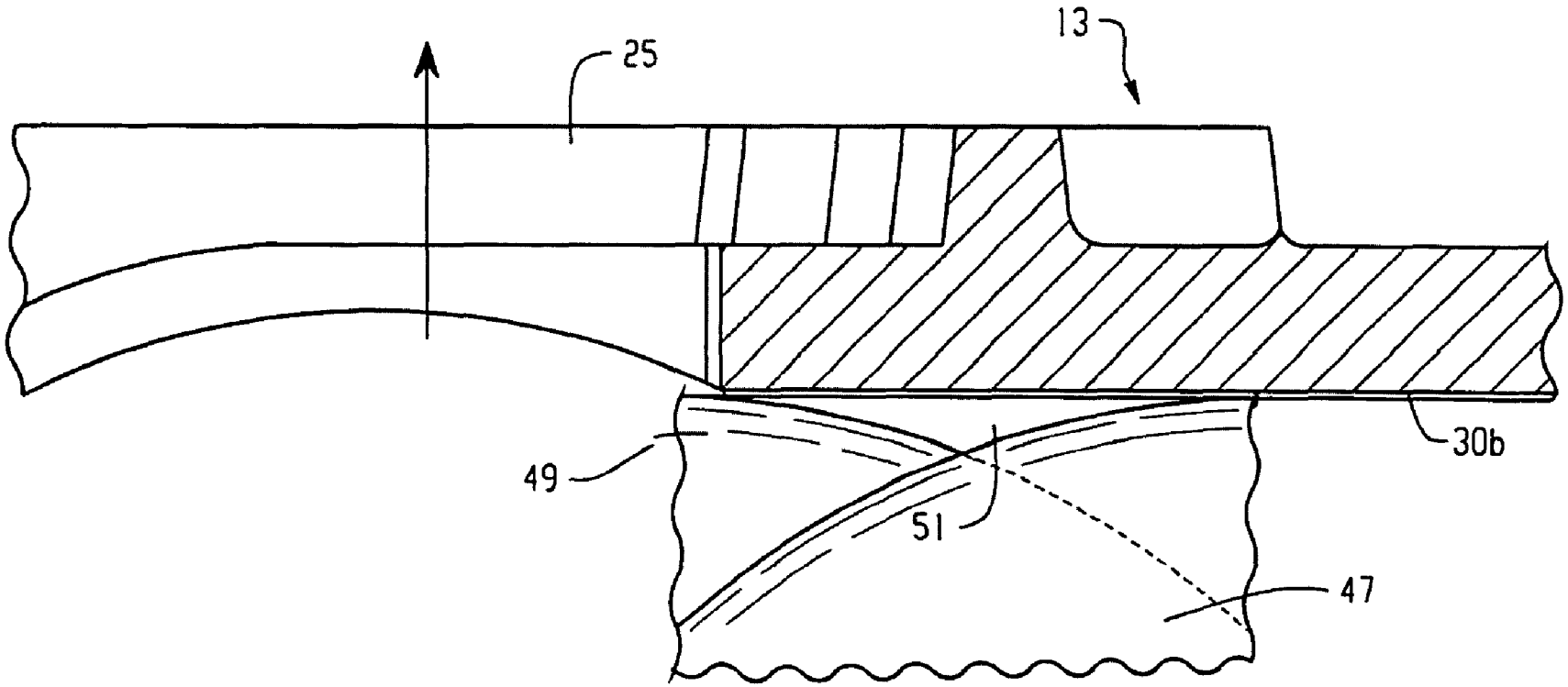
FIG. 7 is an enlarged, fragmentary, axial cross-section similar to FIG. 2, but showing a portion of the lobe mesh, illustrating one important aspect of the invention.

Referring now primarily to FIG. 7, a further advantage of the substantially increased helix angle HA will be described. As the rotors 37 and 39 rotate, the lobes 47 and 49 (i.e., 47*a*, etc., 49*a*, etc.) move into and out of mesh and, instantaneously, cooperate with the adjacent surface of the rotor chambers 27 and 29, along the outlet cusp 30*b*, to define a "blowhole", generally designated 51, which may also be referred to as a backflow port. As each blowhole 51 is "generated" by the meshing of the lobes, the preceding control volume is permitted to communicate with the adjacent control volume. This has been referenced previously as the backflow phase or "event" and it is the intention of this backflow event to allow the adjacent control volume to equalize in pressure prior to opening to the outlet port.

Those skilled in the art will understand that the formation of a blow hole 51 occurs in a cyclic manner, i.e., one blowhole 51 is formed by two adjacent, meshing lobes 47 and 49, the blowhole moves linearly as the lobe mesh moves linearly, in a direction toward the outlet port 19. The blowhole 51 is present until it linearly reaches the outlet port 19. There can be several blowholes 51 generated and present at any one time, depending on the extent of the backflow seal time. The advantage of a "backflow" event, involving a plurality of blowholes 51 is that there is a continuous event that is distributed over several control volumes, which has the potential to even out the transition to the outlet event or phase over a longer time period, improving the efficiency of the backflow event.

One of the benefits which has been observed in connection with this inherent formation of the blowhole 51, resulting from the greater helix angle HA which is one aspect of this invention, is that the need is eliminated for the backflow slots on either side of the outlet port 19 (i.e., typically, one parallel to each side surface 23 or 25). Therefore, as may best be seen in FIG. 1, there is no provision in the blower housing 13, adjacent the outlet port 19 for such backflow slots.

It has been determined that another advantage of the greater helix angle, in accordance with the present invention, is that the blower 13 is able to operate at a higher "pressure ratio", i.e., the outlet pressure (in psia) to inlet pressure (also in psia). By way of contrast, the prior art Roots blower supercharger, produced and marketed commercially by the assignee of the present invention, would reach an operating temperature of 150° Celsius (outlet port 19 air temperature) at a pressure ratio of about 2.0. A blower which is generally identical, other than being made in accordance with the present invention, has been found to be capable of operating at a pressure ratio of about 2.4 before reaching the determined "limit" of 150° Celsius outlet air temperature. This greater pressure ratio represents a much greater potential capability to increase the power output of the engine, for reasons well known to those skilled in the internal combustion engine art.

As is well known to those skilled in the supercharger art, a primary performance difference between screw compressor type superchargers and Roots blower superchargers is that, whereas the conventional, prior art Roots-type blower, with the conventional, smaller helix angle, does not generate any "internal compression" (i.e., does not actually compress the air within the blower, but merely transfers the air), the typical screw compressor supercharger does internally compress the air. However, it has been observed in connection with the design, development, and testing of a commercial embodiment of the present invention that the Roots-type blower 11, made in accordance with the present invention, does generate a certain amount of internal compression. At relatively low speeds, when typically less boost is required, the blowhole 51 (or more accurately, the series of blowholes 51) serves as a "leak path" such that there is no internal compression. As the blower speed increases (for example, as the blower rotors are rotating at 10,000 rpm and then 12,000 rpm etc.) and a correspondingly greater amount of air is being moved, the blowholes 51 still relieve some of the built-up air pressure, but as the speed increases, the blowholes 51 are not able to relieve enough of the air pressure to prevent the occurrence of internal compression, such that above some particular input speed (blower speed), just as there is a need for more boost to the engine, the internal compression gradually increases. Those skilled in the art will understand that in using the rotor design method of the present invention, the skilled designer could vary certain parameters to effectively "tailor" the relationship of internal compression versus blower speed, to suit a particular vehicle engine application.

Figure 8:
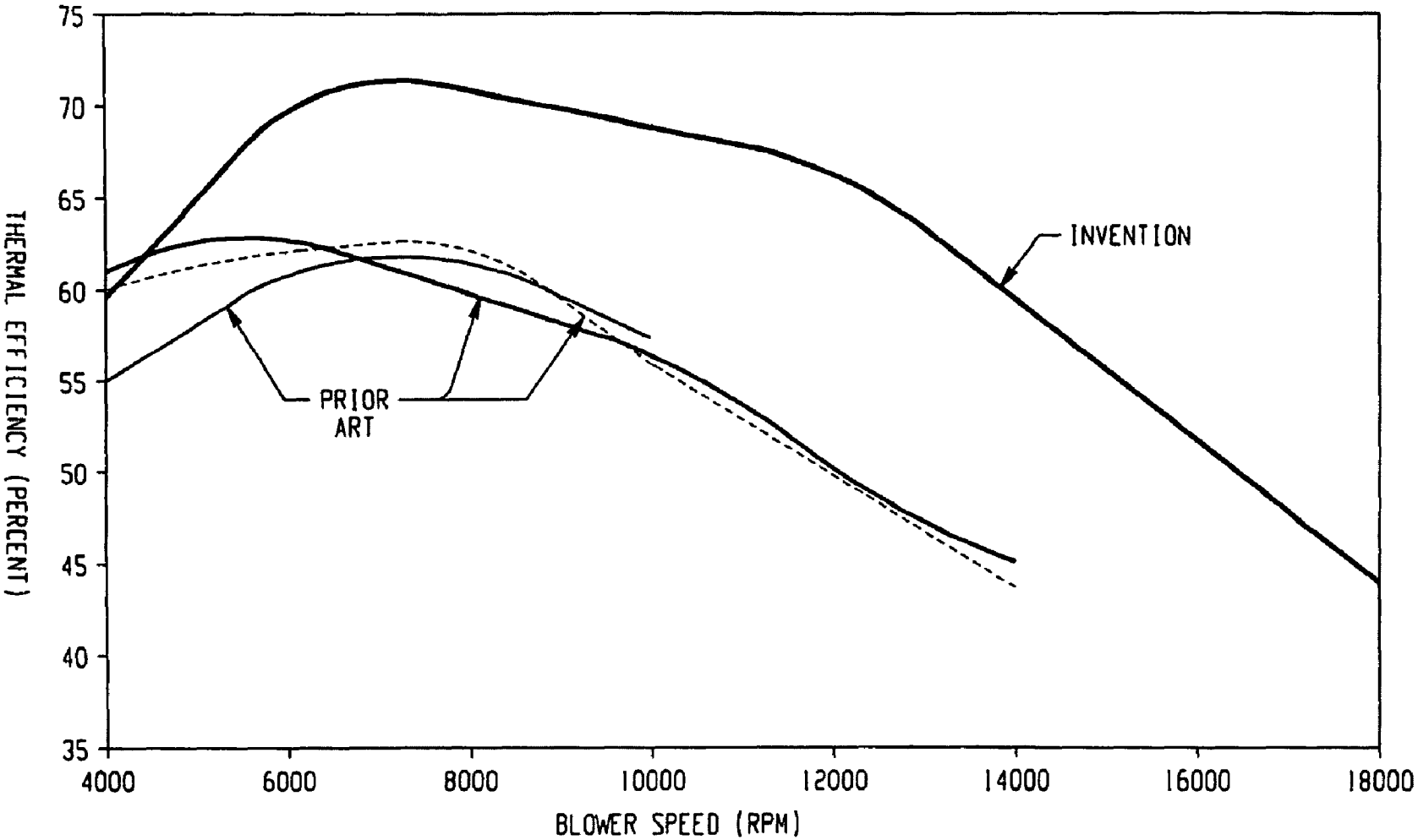
FIG. 8 is a graph of thermal efficiency, as a percent, versus blower rotor speed of rotation (in RPM), comparing the PRESENT INVENTION to the PRIOR ART.

Referring now primarily to FIG. 8, there is provided a graph of thermal efficiency as a function of blower speed in RPM. It may be seen in FIG. 8 that there are three graphs representative of Prior Art devices, with two of the graphs representing prior art Roots-type blowers sold commercially by the assignee of the present invention, those two blowers being represented by the graphs which terminate at 14,000 rpm. The third Prior Art device is a screw compressor, for which the graph in FIG. 6 representing that device terminates at 10,000 RPM, it being understood that the screw compressor could have been driven at a higher speed, but that the test was stopped. As used herein, the term "terminate" in reference to the Prior Art graphs in FIG. 8 will be understood to mean that the unit had reached the determined "limit" of 150° Celsius outlet air temperature, discussed previously. Once that air temperature is reached, the blower speed is not increased any further and the test is stopped.

By way of comparison, it may be seen in FIG. 8 that the Roots-type blower made in accordance with the present invention ("INVENTION") achieves a higher thermal efficiency than any of the Prior Art devices at about 4,500 rpm blower speed, and the thermal efficiency of the INVENTION remains substantially above that of the Prior Art devices for all subsequent blower speeds. What is especially significant is that with the blower of the present Invention, it was possible to continue to increase the blower speed, and the "limit" of 150° Celsius outlet air temperature did not occur until the blower reached in excess of 18,000 rpm.

Although the present invention has been illustrated and described in connection with a Roots-type blower in which each of the rotors 37 and 39 has an involute, four lobe (N=4) design, it should be understood that the invention is not so limited. The involute rotor profile has been used in connection with this invention by way of example, and the benefits of this invention are not limited to any particular rotor profile. However, it is anticipated that for most Roots-type blower designs, the number of lobes per rotor will be either 3, 4, or 5, especially when the blower is being used as an automotive engine supercharger.

Although, within the scope of the present invention, the number of lobes per rotor (N) could conceivably be less than 3 or greater than 5, what will follow now is a brief explanation of the way in which the maximum ideal twist angle ($TA_M$) would change for different numbers (N) of lobes per rotor. In referring back to the equation:

$$TA_M = 360 - (2 \text{ times } X) - (360/N)$$

and assuming that CD and OD remain constant as the number of lobes N is varied, it may be seen in the equation that the first part (360) and the second part (2 times X) are not effected by the variation in the number of lobes, but instead, only the third part, (360/N) changes.

Therefore, as the number of lobes N changes from 3 to 4 to 5, the change in the maximum ideal twist angle $TA_M$ (and assuming the same CD and OD as used previously) will vary as follows:

for $N=3$, $TA_M=360-(2 \text{ times } 50)-(360/3)=140°$;

for $N=4$, $TA_M=360-(2 \text{ times } 50)-(360/4)=170°$; and for $N=5$, $TA_M=360-(2 \text{ times } 50)-(360/5)=188°$ As was explained previously, once the maximum ideal twist angle $TA_M$ is determined and calculated, the helix angle HA may be calculated knowing the length, based upon the diameter (PD) at the pitch circle, and the Leads The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A method of designing a rotor for a Roots-type blower comprising a housing defining first and second transversely overlapping cylindrical chambers, said housing including a first end wall defining an inlet port, and a second end wall, said housing defining an outlet port formed at an intersection of said first and second chambers, and adjacent said second end wall; said blower including first and second meshed, lobed rotors disposed, respectively, in said first and second chambers; each rotor including a plurality N of lobes, each lobe having first and second axially facing end surfaces sealingly cooperating with said first and second end walls, respectively, and a top land sealingly cooperating with said cylindrical chambers, each lobe having its first and second axially facing end surfaces defining a twist angle, and each lobe defining a helix angle; said method of designing a rotor comprising the steps of:

(a) determining a maximum ideal twist angle for said lobe as a function, partially, of said number N of lobes on said rotor, said maximum ideal twist angle being the largest possible twist angle for each rotor lobe without opening a leak path from the outlet port to the inlet port, wherein a total maximum seal time is a sum of an inlet seal time and a transfer seal time, and wherein the transfer seal time is equal to zero at the maximum ideal twist angle;

(b) determining a helix angle for each lobe as a function of said twist angle and an axial length between said first and second axially facing end surfaces of said lobe; and (c) selecting a twist angle corresponding to a desired transfer seal time while keeping the total maximum seal time constant.

2. A method of designing a rotor as claimed in claim 1, wherein said plurality N of lobes comprises at least three, but not more than five lobes.

3. A method of designing a rotor as claimed in claim 1, wherein said outlet port defines an end surface that is disposed adjacent, and generally parallel to, said second end wall, and wherein said outlet port also defines first and second side surfaces, disposed to be traversed by said top land of each lobe of said first and second rotors, respectively, each of said first and second side surfaces cooperating with said end surface to define an angle substantially equal to said helix angle.

4. A method of designing a rotor as claimed in claim 1, wherein said step (a) includes determining said maximum, ideal twist angle as a function of a center-to-center distance defined bys aid first and second rotors, and as a function of an outside diameter defined bys aid top land of said lobes.

5. A method of designing a rotor as claimed in claim 1, wherein said step (b) comprises the determination of a Lead, wherein said Lead is a function of said maximum ideal twist angle and said axial length, said helix angle then being determined in accordance with the equation:

$$\text{Helix Angle (HA)}=(180/\pi*\arctan(PD/\text{Lead})),$$

wherein PD is the pitch diameter of the lobe.

6. A rotor for a Roots-type blower having a housing defining first and second transversely overlapping cylindrical chambers, said housing including a first end wall defining an inlet port, and a second end wall, said housing defining an outlet port formed at an intersection of said first and second chambers, and adjacent said second end wall; said blower including first and second meshed, lobed rotors disposed, respectively, in said first and second chambers; each rotor including a plurality N of lobes, each lobe having first and second axially facing end surfaces sealingly cooperating with said first and second end walls, respectively, and a top land sealingly cooperating with said cylindrical chambers, each lobe having its first and second axially facing end surfaces defining a twist angle, and each lobe defining a helix angle; said rotor comprising:

the twist angle for said lobe being a maximum ideal twist angle that is a function, partially, of said number N of lobes on said rotor, said maximum ideal twist angle being the largest possible twist angle for each rotor lobe without opening a leak path from the outlet port to the inlet port, wherein a total maximum seal time is a sum of an inlet seal time and a transfer seal time, and wherein the transfer seal time is equal to zero at the maximum twist angle; and the helix angle for each lobe being a function of said twist angle and an axial length between said first and second axially facing end surfaces of said lobe, wherein the twist angle corresponds to a desired transfer seal time that is selected while keeping the total maximum seal time constant.

7. A rotor as claimed in claim 6, wherein said plurality N of lobes comprises at least three, but not more than five lobes.

8. A rotor as claimed in claim 6 wherein said maximum, ideal twist angle being a function of a center-to-center distance defined bys aid first and second rotors, and a function of an outside diameter defined by said top land of said lobes.

9. A rotor as claimed in claim 6, wherein said rotor including a Lead, and wherein said Lead is a function of said maximum ideal twist angle and said axial length, said helix angle being determined in accordance with the equation:

$$\text{Helix Angle (HA)}=(180/\pi*\arctan(PD/\text{Lead})),$$

wherein PD is the pitch diameter of the lobe.

* * * * *

UNITED STATES PATENT AND TRADEMARK OFFICE

CERTIFICATE OF CORRECTION

PATENT NO. : 7,866,966 B2
APPLICATION NO. : 12/331911
DATED : January 11, 2011
INVENTOR(S) : Matthew G. Swartzlander It is certified that error appears in the above-identified patent and that said Letters Patent is hereby corrected as shown below:

Claim 4, column 12, line 9, delete “bys aid” and insert --by said--.

Claim 4, column 12, line 10, delete “bys aid” and insert --by said--.

Claim 8, column 12, line 54, delete “bys aid” and insert --by said--.

Signed and Sealed this
Fifth Day of April, 2011

David J. Kappos

David J. Kappos
*Director of the United States Patent and Trademark Office*